United States Patent [19]

Roccaforte

[11] 4,300,683

[45] Nov. 17, 1981

[54] DISPLAY CARD

[75] Inventor: Harry Roccaforte, Western Springs, Ill.

[73] Assignee: Champion International Corporation, Stamford, Conn.

[21] Appl. No.: 109,193

[22] Filed: Jan. 3, 1980

[51] Int. Cl.[3] ..... B65D 5/50

[52] U.S. Cl. ..... 206/485; 206/45.14; 206/45.19; 248/152

[58] Field of Search ..... 206/485, 45.14, 45.19; 248/152, 174

[56] References Cited

U.S. PATENT DOCUMENTS

| | | | |
|---|---|---|---|
| 3,002,722 | 10/1961 | Cote | 206/45.14 |
| 3,070,222 | 12/1962 | Jones | 206/45.14 |
| 3,157,275 | 11/1964 | Tolaas | 206/45.14 |
| 3,437,193 | 4/1969 | Freeman | 206/45.14 |
| 3,658,175 | 4/1972 | Vrana | 206/45.14 |
| 3,812,957 | 5/1974 | Forbes, Jr. | 206/45.14 |

*Primary Examiner*—William T. Dixson, Jr.
*Attorney, Agent, or Firm*—Evelyn M. Sommer

[57] ABSTRACT

A display card comprising a base having the shape of a right triangle with a hypotenuse panel, a horizontal leg panel and a vertical leg panel, said base resting on the horizontal leg panel with the hypotenuse panel facing upwardly and outwardly, a top having the shape of a right triangle with a hypotenuse panel, a horizontal leg panel and a vertical leg panel, the hypotenuse panel facing downwardly and outwardly, a wall joining the top end and base along the vertical leg panels and an orifice in both the top and base hypotenuse panels whereby a product may be secured in the orifices for display and protection purposes.

25 Claims, 9 Drawing Figures

DISPLAY CARD

BACKGROUND OF THE INVENTION

A great many products are packaged today for display purposes. The packages which contain these products must not only provide a pleasing display to the sight but also must protect the product contained therein. Most of the packages contain the product completely enclosed therein and, in such case, the product is not visible to the eye and the package must contain a picture or have an appropriate display printed thereon in order for the product to be recognized. If the product is contained in a small bottle or jar, such bottles or jars are usually contained within a larger package which holds a number of the bottles or jars thus, again, making access and visibility to the public difficult. If the bottle or jar or similar container is packaged individually in such a way that it is visible to the naked eye, the packages become quite complex because the container must be secured about both the base and the top thereof which leaving the center portion uncovered to allow maximum visibility to the buying public. As stated earlier, such packages are complex and difficult to make and in the past have consisted of a number of separate panels glued or otherwise fastened to each other to make a unitary package.

SUMMARY OF THE INVENTION

The present invention overcomes the difficulties of the prior art and consists of a one piece display card that protects and displays a product. Thus, the invention relates to a display card comprising a base having the shape of a right triangle with a hypotenuse panel, a horizontal leg panel and a vertical leg panel, said base resting on said horizontal leg panel with said hypotenuse panel facing upwardly and outwardly, a top having the shape of a right triangle with a hypotenuse panel, a horizontal leg panel and a vertical leg panel, said hypotenuse panel facing downwardly and outwardly, a wall joining said top and base along said vertical leg panels, and an orifice in both the top and base hypotenuse panels whereby a product may be secured in said orifices for display and protection purposes.

Since the package is manufactured from a single piece of packaging material such as paperboard, the invention relates to a display card blank comprising a front wall and back wall hingedly attached to each other, an extension panel hingedly attached to each end of said back wall, an extension panel hingedly attached to each end of said front wall, each said front wall extension panel comprising inner and outer wings hingedly attached to each other and an orifice in said inner wing of each said front wall extension panel.

BRIEF DESCRIPTION OF THE DRAWINGS

These and other objects and advantages of the present invention will be disclosed in the course of the following specification, reference being had to the accompanying drawings, in which:

FIG. 2 is formed.

FIG. 2 is formed.

DETAILED DESCRIPTION OF THE DRAWINGS

Figure 1:
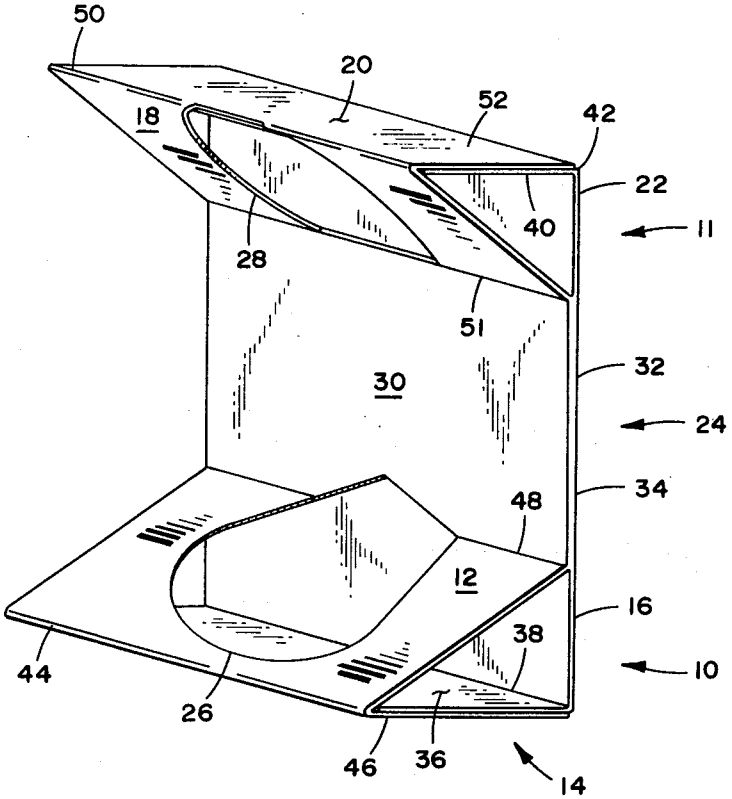
FIG. 1 is a perspective view of a preferred embodiment of the inventive display card.

FIG. 1 is a perspective view of a preferred embodiment of the inventive display card that protects and displays a product. The display card shown in FIG. 1 comprises a base 10 having a shape of a right triangle with a hypotenuse panel 12, a horizontal leg panel 14, and a vertical leg panel 16. The top 11 of the novel display card is also in the shape of a right triangle with hypotenuse panel 18, horizontal leg panel 20, and vertical leg panel 22. It will be noted that the hypotenuse panel 12 of the base 10 faces upwardly and outwardly while the hypotenuse panel 18 of top 11 faces downwardly and outwardly. A wall 24 joins top 11 and base 10 along vertical leg panels 16 and 22. An orifice 26 is located in the hypotenuse panel 12 of base 10 and orifice 28 is located in the hypotenuse panel 18 of top 11. These orifices are used to contain and display a product which may be in a bottle or other container of various shapes such as circular, oval, square, or rectangular. The circular orifices shown are for illustrative purposes only.

In actual practice, the novel display card is constructed from a unitary blank and thus wall 24 comprises a front wall 30 and a back wall 32 hingedly connected to each other along at least a portion 34 of one side thereof and are superimposed over and attached to each other in an overlapping, abutting relationship. Extension 36 is hingedly attached at 38 to the lower end of back wall 32 while extension 40 is hingedly attached at 42 to the upper end of back wall 32.

A V-shaped panel 44 having an inner wing forming hypotenuse panel 12 and an outer wing 46 forming the lower panel of horizontal leg panel 14 is hingedly attached to the lower end of front wall 30 at hinge line 48. Outer wing 46 is superimposed over and attached to back wall extension 36 to form the horizontal leg panel 14.

Upper V-shaped panel 50 has an inner wing corresponding to hypotenuse panel 18 and an outer wing 52 comprising the upper panel of horizontal leg panel 20. Outer wing 52 is superimposed over and attached to back wall extension 40 thus forming a top of right triangular cross section.

It will be noted that the orifice 26 in the display card base is larger than orifice 28 in the display card top. This enables a product to be secured therein for display purposes whose base is larger than its top. If necessary, of course, the size of the orifices could be changed so that the upper orifice is larger than the lower orifice or both orifices could be of the same size.

It will also be noted that V-shaped panel 50 is integrally formed with and hingedly attached at hinge line 51 to front wall 30. Thus a top of right triangular cross section is formed by outer wing 52 of V-shaped panel 50, overlapping back wall extension 40 and vertical leg 22 being attached to extension 40 in a fixed relationship.

Figure 2:
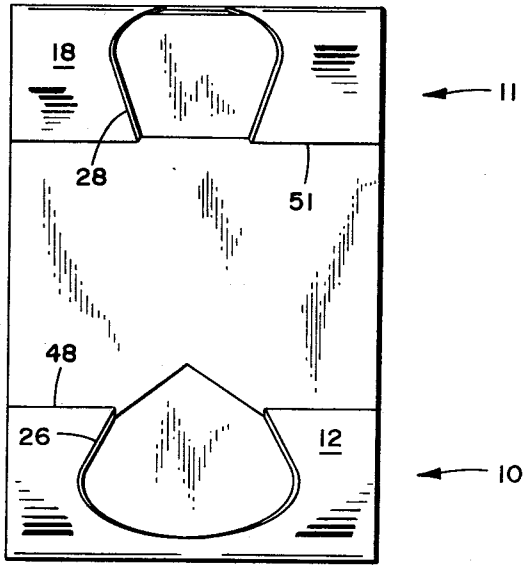
FIG. 2 is a front view of the novel display card illustrated in FIG. 1.

FIG. 2 is a front view of the novel display card illustrated in FIG. 1. Inner wing or hypotenuse panel 18 forming right triangular top 11 can be seen with orifice 28 therein. It will be noted that inner wing 18 is hingedly attached to front wall 30 at hinge line 51. In like manner, hypotenuse panel or inner wing 12 of the right triangular base 10 can be seen with orifice 26 therein. It will again be noted that hypotenuse panel or inner wing 12 is hingedly attached to the base of front wall 30 at hinge line 48.

Figure 3:
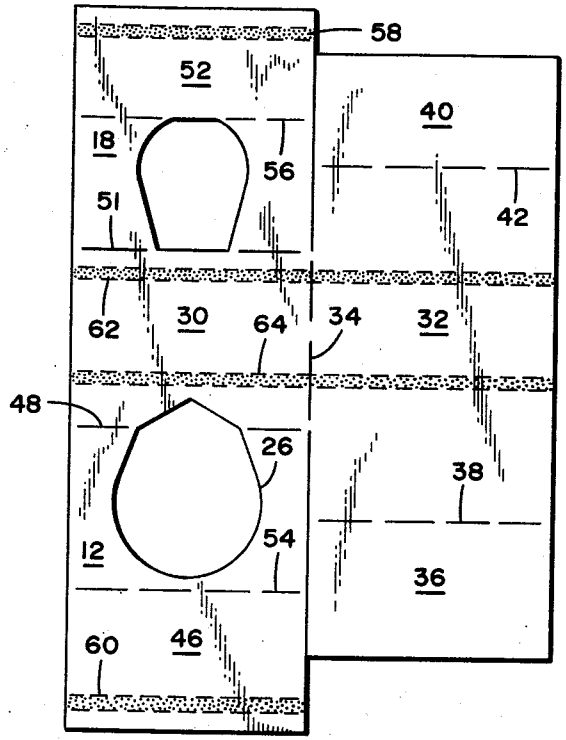
FIG. 3 is a plan view of the unitary blank from which the novel display card illustrated in FIG. 1

FIG. 3 is a plan view of the unitary blank from which the novel display card illustrated in FIG. 1 and FIG. 2 is formed. Where possible, like numerals are used to indicate like elements in FIGS. 1, 2 and 3.

As can be seen in FIG. 3, the novel blank includes front wall 30 and back wall 32 hingedly formed with and hingedly connected to each other along at least a portion 34 of one side thereof. A lower panel comprising inner wing 12 and outer wing 46 hingedly attached to each other at hinge line 54 is hingedly attached to the lower end of front wall 30 by means of score line 48. An orifice 26 is formed in inner wing 12. The V-shaped panel 44 in FIG. 1 is formed by folding outer wing 46 about score line 54 under inner wing 12 as shown in FIG. 1.

In like manner, an upper panel comprising inner wing 18 and outer wing 52 integrally joined together by hinge line 56 is hingedly attached to the upper end of front wall 30 at hinge line 51. Again, by folding outer wing 52 over inner wing 18 about hinge line 56, a V-shaped panel 50 is formed as shown in FIG. 1.

Back wall 32 has extension 36 hingedly attached to the bottom thereof at hinge line 38 and extension 40 hingedly attached to the upper end thereof at hinge line 42. When back wall extensions 36 and 40 are folded inwardly about their respective score lines 38 and 42, they form a portion of the horizontal leg panels of the respective right triangular top and base of the display panel. In those positions, outer wing 52 of the front wall V-shaped paenl 50 has a glue strip 58 on the other side thereof which attaches it in a fixed relationship to the top of back wall extension panel 40. In like manner, outer wing 46 of the lower front wall V-shaped panel has a glue strip 60 on the underside thereof which is folded over and overlaps lower back wall extension 36 and is attached thereto in a fixed relationship.

Also, when the back wall 32 is folded under front wall 30 about score line 34, they are adhesively secured together. To accomplish this purpose, at least one glue strip extends across at least one of said front or back panels. In the preferred embodiment, as shown in FIG. 3, glue strips 62 and 64 extend across both front wall 30 and back wall 32 on the underside thereof.

Figure 4:
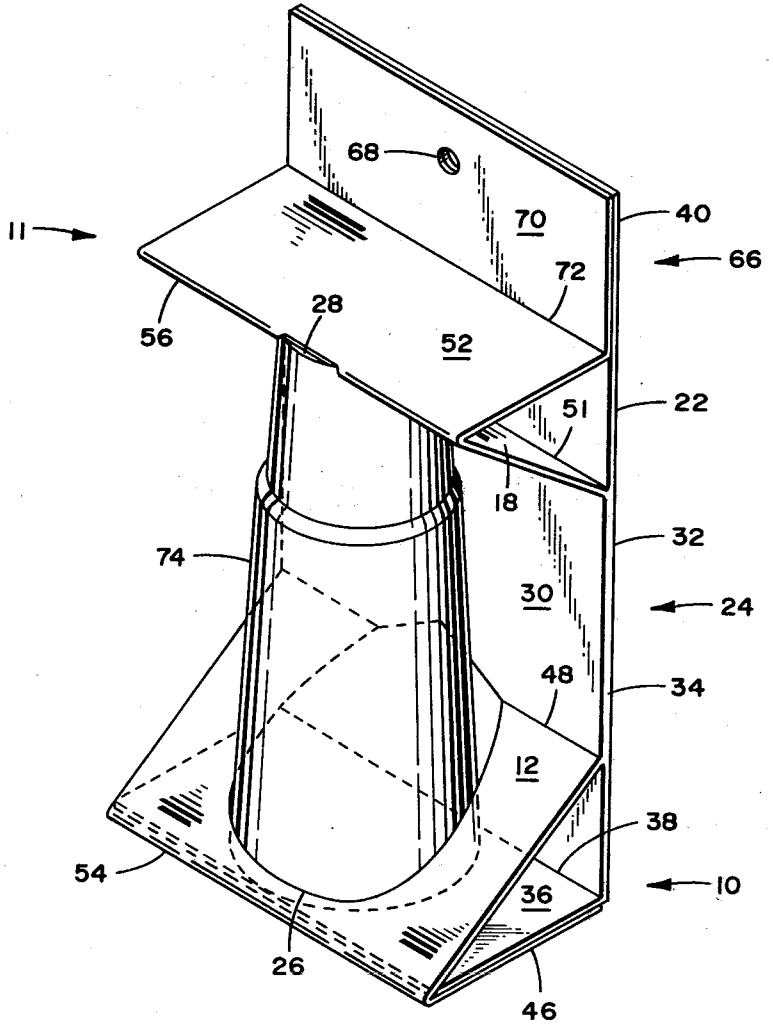
FIG. 4 is a perspective view of an alternate embodiment of the inventive display and support card.

FIG. 4 is a perspective view of an alternate embodiment of the present invention which also illustrates the manner in which a product container is secured and displayed in the card. The only visual difference between the embodiment of FIG. 1 and the embodiment of FIG. 4 is an extended panel 66 attached to vertical leg panel 22 and projecting above card top 11 whereby additional graphic space is provided. If desired, an orifice 68 may be placed in the extended panel 66 whereby the card may be displayed in hanging fashion on a projection extending through orifice 68. Again, both the base 10 and the top 11 of the card are generally of a right triangular cross section with an orifice in each of the hypotenuse panels in opposing relationship. Again, wall portion 24 comprises a front wall 30 and a back wall 32 hingedly connected to each other along hinge line 34. Again, back wall 32 has a panel extension 36 hingedly attached thereto at hinge line 38 on the lower end and a panel extension 66 on the upper end thereof. The panel extension 36 on the lower end is folded inwardly about hinge line 38 towards the front wall in a horizontal plane. The V-shaped panel attached by means of score line 48 to the lower end of front panel 30 comprises an inner wing 12 and an outer wing 46. Outer wing 46 is folded under and adhesively attached to back wall extension panel 36. Again, an orifice 26 is formed in inner wing or hypotenuse panel 12 to receive a product container.

In like manner, the upper V-shaped panel comprising inner wing or hypotenuse panel 18 and outer wing 52, also known as the horizontal leg panel, along with back wall vertical leg panel 22 form the top of the card with a right triangular cross section.

Extended panel 66, in actual construction, comprises a wing extension 70 hingedly connected to horizontal leg panel or outer wing 52 at hinge line 72. Wing extension 70 is then glued or otherwise attached to back wall extension 40 which, in this case, is not folded over towards the front panel but remains in a vertical plane. Again, an orifice 28 is formed in hypotenuse panel or inner wing 18 of the top 11. In the FIG. 4 illustration, a product container 74 is illustrated to indicate the maner in which it is secured and displayed by the inventive card.

Figure 5:
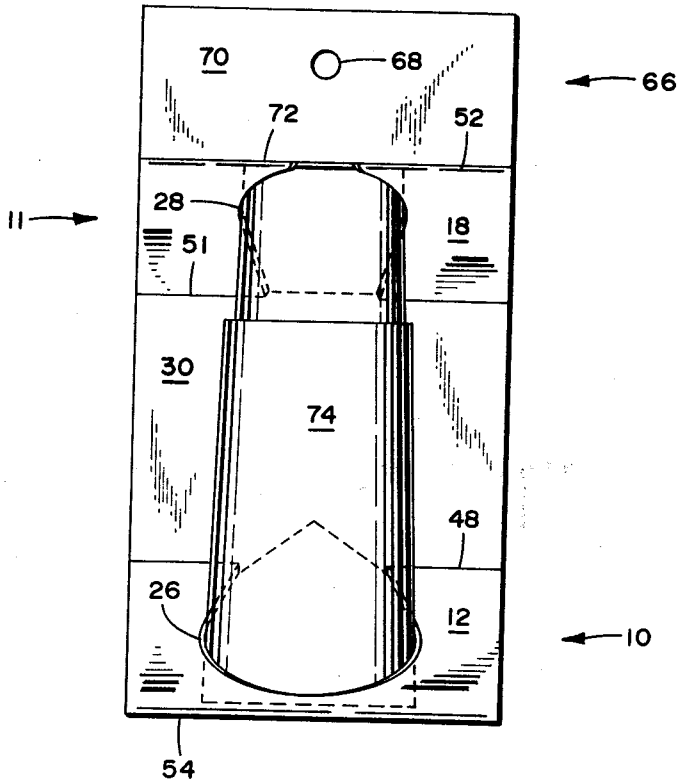
FIG. 5 is a front view of the novel display card illustrated in FIG. 4.

FIG. 5 is a front view of the display card illustrated in FIG. 4. Inner wing or hypotenuse panel 18 of top 11 is illustrated with the orifice 28 therein. It is hingedly attached along hinge line 51 to front wall 30. Also, extended panel 66 is illustrated with wing extension 70 being shown hingedly connected to outer wing or horizontal leg panel 52 at hinge line 72. Orifice 68 can be seen in extended panel 66.

The base 10 of the display card includes hypotenuse panel or inner wing 12 which is hingedly connected to the bottom of front wall 30 at hinge line 48. Orifice 26 is also shown therein. Product container 74 is illustrated as being secured within orifices 26 and 28 of the respective base 10 and top 11 of the display card.

Figure 6:
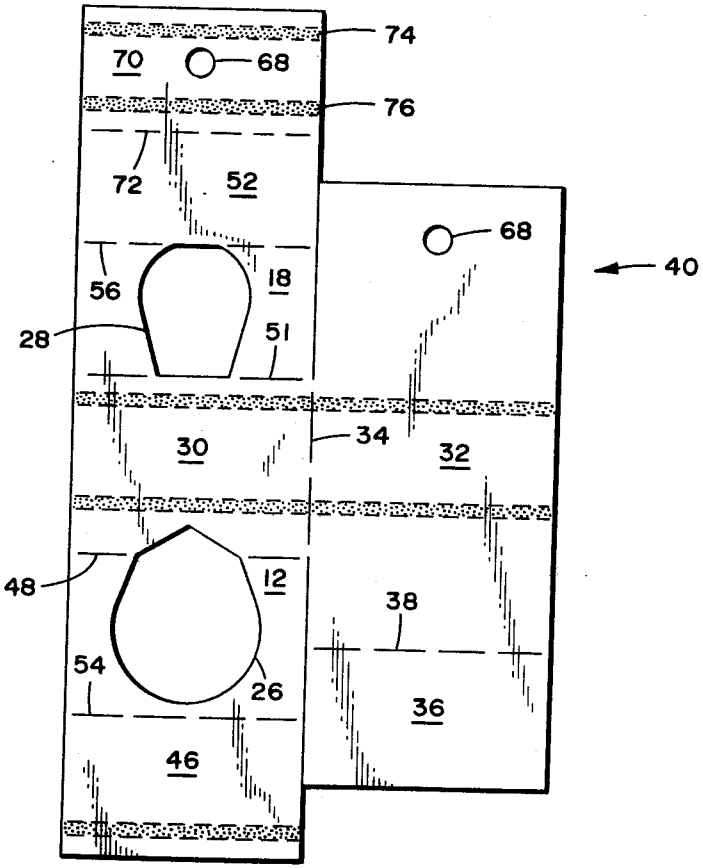
FIG. 6 is a plan view of a unitary blank from which the novel display card illustrated in FIG. 1

FIG. 6 is a plan view of a unitary blank from which the novel display card illustrated in FIG. 4 may be constructed. Back wall 32 has a panel extension 36 attached at the lower end thereof by hinge line 38 and an upper panel extension 40 formed as an integral part of the upper end thereof. The panel extension 36 on the lower end of back wall 32 may be folded about said hinge 38 toward the front wall 30 in a horizontal plane when the blank is used to form the display card. However, the upper panel extension 40 may remain in the vertical plane. Front wall 30 is integrally formed with and hingedly attached to back wall 32 and along at least a portion of one edge by hinge line 34.

An extension panel is also hingedly attached to each end of said front wall at hinge lines 48 and 51 respectively. The lower front wall extension panel comprises inner wing 12 and outer wing 46 integrally formed and hingedly attached to each other along score line 54. An orifice 26 is located in inner wing 12. It will be noted in FIG. 4 that inner wing 12 and outer wing 46 form a V-shaped panel which cooperate with the lower portion 36 of back wall 32 to form a base 10 having a right triangular shape or cross section. Inner wing 12 forms the hypotenuse of the triangle, outer wing 46 and overlapping back wall extension 36 form the horizontal leg and the lower part of back wall 32 forms the vertical leg. The upper extension panel comprises an inner wing 18 and an outer wing 52 integrally formed with and hingedly attached to each other at hinge line 56. An orifice 28 is shown in inner wing 18. Again, as shown in FIG. 4, a V-shaped panel is formed by inner wing 18 and outer wing 52 when they are folded about score line 56 to cooperate with the back wall 32 and form a top 11 having a right triangular shape or cross section. Inner wing 18 becomes the hypotenuse of the right triangle, outer wing 52 becomes the horizontal leg of the triangle and an upper portion of back wall 32 becomes the vertical leg of the triangle. Also shown in FIG. 6 is wing extension 70 integrally formed with and hingedly connected to outer wing 52 by means of score line 72. When the card is in its completely folded state, as shown in FIG. 4, display panel extension 70 is in overlapping and abutting relationship to the upper panel extension 40 of back wall 30 and is attached thereto in fixed relationship by means of glue strips 74 and 76 shown on the underside thereof in FIG. 6. In such overlapping and abutting relationship, orifices 68 in both display panel extension 70 and back wall extension 40 are aligned with each other to form the orifice 68 shown in FIG. 4.

Figure 7:
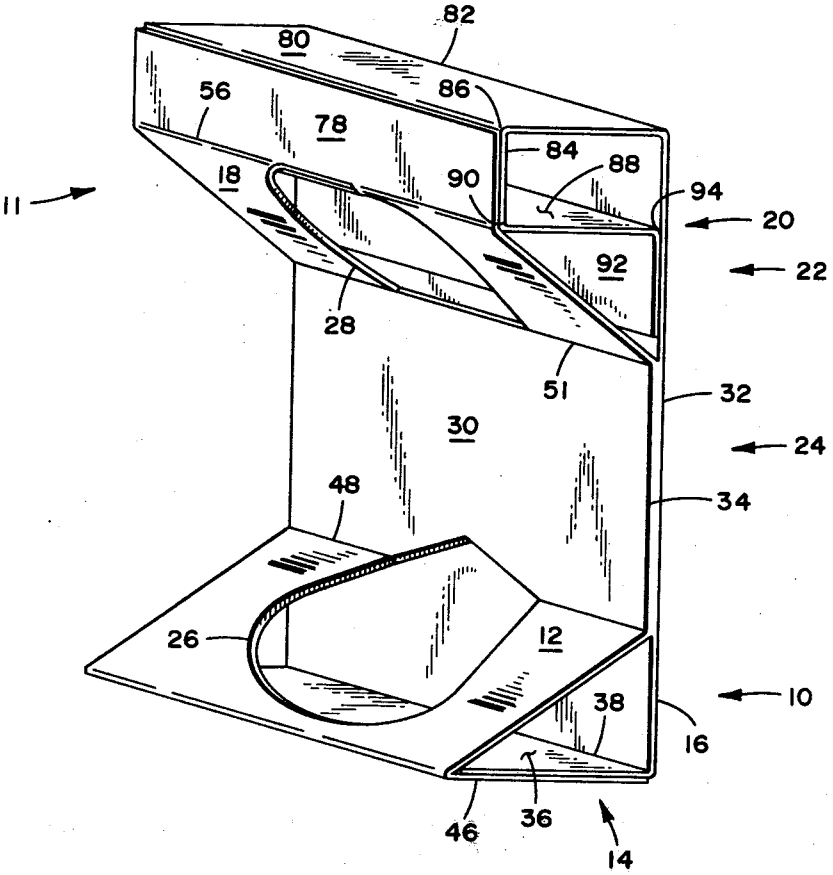
FIG. 7 is a perspective view of a second alternate embodiment of the inventive display and support card.

FIG. 7 is a perspective view of a second alternate embodiment of the novel display card. Again, the base 10 has the shape of a right triangle with a hypotenuse panel 12, a horizontal leg panel 14 and a vertical leg panel 16 with the base 10 resting on the hypotenuse leg panel 14 and with the hypotenuse panel 12 facing upwardly and outwardly.

In like manner, the top 11 has the shape of a right triangle with a hypotenuse panel 18, a horizontal leg panel 20 and a vertical leg panel 22 with the hypotenuse panel 18 facing downwardly and outwardly and opposing hypotenuse panel 12 of base 10. A wall 24 joins the top 11 and base 10 along the vertical leg panels 16 and 22. An orifice 28 is located in upper hypotenuse panel 18 and orifice 26 is located in lower hypotenuse panel 12 whereby a product may be secured in the orifices for display and protective purposes.

In actual construction, the card is formed from a front wall 30 and a back wall 32 integrally formed with and hingedly connected to each other along at least a portion 34 of one side thereof and superimposed over and attached to each other in an overlapping relationship. A back panel extension 36 is hingedly attached to back wall 32 at hinge line 38 and is folded about hinge line 38 towards said front wall 30 in a horizontal plane.

A V-shaped panel having inner wing 12 and outer wing 46 is hingedly attached to the lower end of front wall 30 by score line 48. As can be seen in FIG. 7, outer wing 46 is superimposed over and attached to the corresponding lower back wall extension 36 whereby a base for the display card having a right triangular cross section is formed. An upper extension panel 18 is hingedly attached to and extends upwardly and outwardly from the upper end of front wall 30 by means of score line 51. A glue panel extension 78 is hingedly attached to upper extension panel 18 at score line 56 and extends vertically therefrom. A panel extension on the upper end of back wall 32 comprises a first extension panel 80 hingedly attached to the upper end of back wall 30 at score line 82 and is folded inwardly towards glue panel extension 78. A second extension panel 84 is hingedly attached to first extension panel 80 by means of score line 86 and is folded downwardly in juxtaposed relationship to glue panel 78. A third extension panel 88 is hingedly attached to second extension panel 84 at hinge line 90 and is folded outwardly, spaced apart from, of equal length with and parallel to, the first extension panel 80. A fourth extension panel 92 is hingedly attached to the third extension panel 88 at hinge line 94 and is folded downwardly in abutting relationship with upper back wall 32. Glue panel 78 is attached to second extension panel 84 in any well-known manner such as by the use of an adhesive and fourth extension panel 92 is attached to back wall 32 by means of an adhesive. Thus the top 11 of the panel display is formed of a right triangular cross section having a buffer of rectangular cross section formed above and with the panel top. An orifice 26 is located in the inner wing 12 of the lower V-shaped panel and orifice 28 is located in upper extension panel 18 an opposing relationship to each other whereby a product may be secured in the orifices for display and protection purposes.

Figure 8:
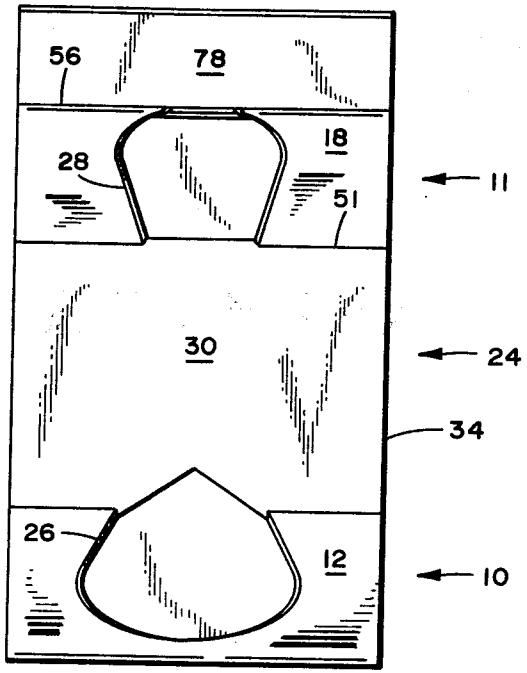
FIG. 8 is a front view of the novel display and support card illustrated in FIG. 7.

FIG. 8 is a front view of the novel display card illustrated in FIG. 7. Base 10 and top 11 are joined by wall 24. Wall 24 actually consists of a front wall 30 and a back wall 32 hingedly connected together at hinge line 34 and folded over each other in overlapping relationship. Inner wing or hypotenuse panel 12 of base 10 is hingedly attached to the lower edge of front wall 30 by hinge line 48. Upper extension panel 18 is shown hingedly attached to the upper edge of front wall 30 by means of score line 51. An orifice 26 is shown in inner wing 12 and an orifice 28 is illustrated in upper extension panel 18. Glue panel 78 is attached to the upper extension panel 18 by means of score line 56.

Figure 9:
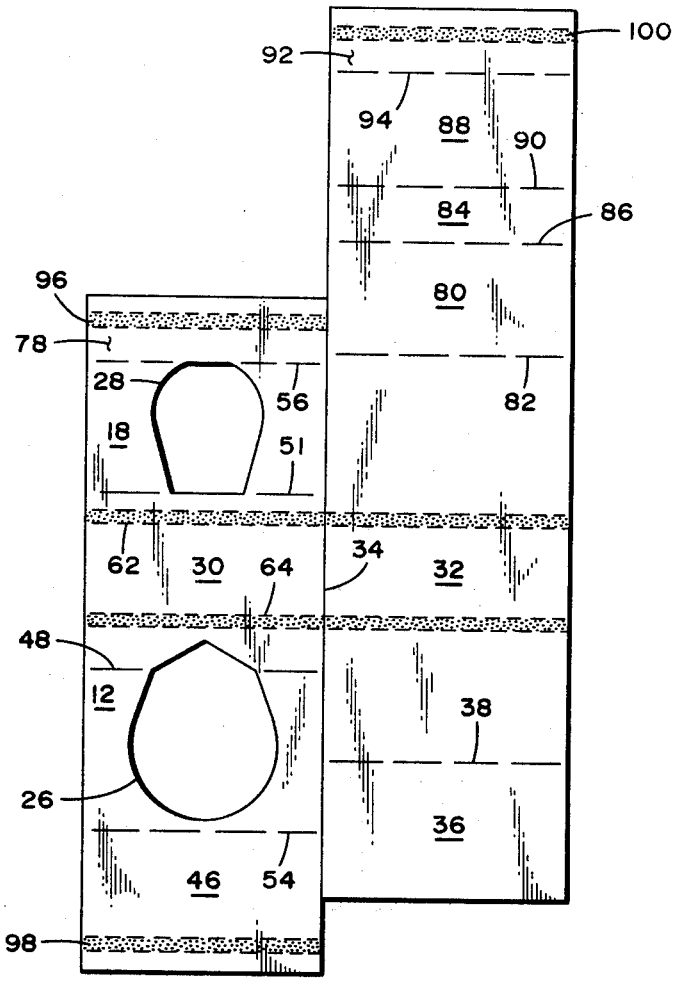
FIG. 9 is a plan view of a unitary blank from which the novel display card illustrated in FIG. 7 and FIG. 8 may be constructed.

FIG. 9 is a plan view of a unitary blank from which the novel display card illustrated in FIG. 7 and FIG. 8 may be constructed. In FIG. 9, front wall 30 and back wall 32 are integrally formed with and hingedly connected to each other along at least a portion of one edge by hinge line 34. An extension panel 36 is hingedly attached at hinge line 38 to the bottom of back wall 32 and an upper extension panel is hingedly attached to the upper end of back wall 32 at score line 82. The upper extension panel has four sections hingedly attached to each other which, when folded upon consecutive hinge lines, forms an open ended rectangular box of rectangular cross section with the outer section lying against and being attached to the back wall. Thus, first section 80 is hingedly attached to the upper end of back wall 32 by means of score line 82. Second extension 84 is hingedly attached to first section 80 by means of score line 86. Third section 88 is hingedly attached to second section 84 by means of score line 90 and fourth section 92 is hingedly attached to third section 88 by means of score line 94.

An extension panel is also hingedly attached to each end of the front wall 30. The lower extension panel comprises inner wing 12 and outer wing 46 hingedly attached to each other at score line 54. The upper front wall extension panel has an inner wing 18 and an outer wing or glue panel 78 hingedly attached to each other by means of score line 56. Orifice 26 is located in inner wing 12 of the lower front wall extension panel and orifice 28 is located in the inner wing 18 of the upper front wall extension panel. At least one glue strip 96 and 98 is formed on each outer wing 46 and 78 respectively of the upper and lower front wall extensions thus allowing the lower extension outer wing 46 to be attached to the corresponding back wall extension 36 when the card is completed and the upper wing 78 may be attached to the second section 84 of the upper back wall extension panel.

Further, at least one glue strip extends across at least one of the front or back walls 30 and 32 respectively for attaching the front and back walls 30 and 32 in an overlapping relationship. In FIG. 9, glue strips 62 and 64 extend completely across the underside of both the back and front walls 30 and 32. Also, glue strip 100 on fourth section 92 of the back wall upper extension is utilized to attach the fourth section to back wall 32 when the card is completely folded.

It will be noted in all embodiments that the horizontal leg portion of the base is larger than the horizontal leg portion of the top. This of course gives better stability to the card so that it may stand in a display with the product contained therein. Moreover, as used herein, the term "display card" is intended to cover a card serving to support a product as well as display and protect it.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A display card constructed from a unitary blank comprising:

a. a base having the shape of a right triangle with a hypotenuse panel, a horizontal leg panel and a vertical leg panel, said base resting on said horizontal leg panel with said hypotenuse panel facing upwardly and outwardly, b. a top having the shape of a right triangle with a hypotenuse panel, a horizontal leg panel and a vertical leg panel, said hypotenuse panel facing downwardly and outwardly, c. a wall joining said top and base along said vertical leg panels, said wall including a front wall portion and a back wall portion hingedly connected along at least a portion of one side thereof, said wall portions superimposed over and attached to each other, and d. an orifice in both the top and base hypotenuse panels in opposing relationship whereby a product may be secured in said orifices for display and protection purposes.

2. A display card as in claim 1 further including an extended panel attached to said vertical leg panel of and projecting above said card top whereby additional graphics space is provided.

3. A display card as in claim 2 further including an orifice in said extended panel whereby said card may be displayed in hanging fashion on a projection.

4. A display card as in claim 1 wherein said orifice in said base hypotenuse panel is larger than said orifice in said top hypotenuse panel to secure a product whose base is larger than its top.

5. A display card as in claim 1 further including:

a. a glue panel extension attached to and projecting upwardly above the outwardly extending apex of said right triangular shaped top, b. said wall joining said top and base projecting upwardly above said card top horizontal leg panel a distance equal to the upward projection of said glue panel, c. a first extension panel hingedly attached to said wall top and folded inwardly, spaced apart from and equal in length to said horizontal leg panel of said triangular shaped top, and d. a second extension panel hingedly attached to said first extension panel and folded downwardly and attached to said glue panel whereby a buffer of rectangular cross section is formed above and with said horizontal leg of said triangular shaped top to enhance said display card and provide additional graphic space.

6. A display card as in claim 5 wherein:

a. said glue panel is hingedly attached to said hypotenuse panel of said right triangular shaped top, and b. said horizontal leg portion of said right triangular shaped top is a third extension panel hingedly attached to said second extension panel.

7. A display card as in claim 6 further including:

a. a fourth extension panel hingedly attached to said third extension panel and folded downwardly in abutting relationship with said back wall, and b. means attaching said fourth extension panel to said back wall in a fixed relationship.

8. A display card constructed from a unitary blank comprising:

a. a front wall, b. a back wall hingedly connected to said front wall along at least a portion of one side thereof and superimposed over and attached thereto, c. a respective extension hingedly attached to each end of said back wall, said extensions being folded about said hinges toward said front wall in a horizontal plane, d. a respective V-shaped panel having inner and outer wings hingedly attached to each of the upper and lower ends of said front wall, the outer wing of each V-shaped panel being superimposed over and attached to a corresponding one of said back wall extensions whereby a top and a base of right triangular cross section is formed, and e. an orifice in each inner wing of said V-shaped panels whereby a product may be secured in said orifices for display and protection purposes.

9. A display card as in claim 8 wherein said orifice in said inner wing of the lower V-shaped panel is larger than the orifice in said inner wing of the upper V-shaped panel where a product whose base is larger than its top may be secured therein for display and protection purposes.

10. A display card constructed from a unitary blank comprising:

a. a front wall having an upper and a lower end, b. a back wall having an upper and a lower end hingedly connected to said front wall along at least a portion of one side thereof and superimposed over and attached thereto, c. a panel extension on each end of said back wall, said panel extension on said lower end being hingedly attached to said back wall and being folded about said hinge toward said front wall in a horizontal plane, d. a respective V-shaped panel having inner and outer wings being hingedly attached to each of the upper and lower ends of said front panel, the outer wing of said lower V-shaped panel being superimposed over and attached to its corresponding back wall extension whereby a base for said display card having a right triangular cross section is formed, e. the outer wing of said upper V-shaped panel extending horizontally to said back wall, f. a display panel extension hingedly connected to the outer edge of said outer wing of said upper V-shaped panel and folded upwardly about said hinge in juxtaposed relationship to said upper panel extension of said back wall, g. means attaching said display panel extension to said upper panel extension in fixed relationship whereby a top for said display card is formed having a right triangular cross section and an upwardly projecting extension for additional graphic space, and h. orifices in each inner wing of said V-shaped panels whereby a product may be secured in said orifices for display and protection purposes.

11. A display card as in claim 10 wherein said orifice in said inner wing of the lower V-shaped panel is larger than the orifice in said inner wing of said upper V-shaped panel whereby a product may be secured therein for display purposes whose base is larger than its top.

12. A display card as in claim 10 further including an orifice through said display panel extension and said upper panel extension whereby said card may be displayed in hanging fashion from a projection extending through said orifice.

13. A display card constructed from a unitary blank comprising:

a. a front wall having an upper and a lower end, b. a back wall having an upper and a lower end hingedly connected to said front wall along at least a portion of one side thereof and superimposed over and attached thereto, c. a panel extension on each end of said back wall, said panel extension on said lower end being hingedly attached to said back wall and folded about said hinge towards said front wall in a horizontal plane, d. a V-shaped panel having inner and outer wings being hingedly attached to the lower end of said front wall, the outer wing thereof being superimposed over and attached to the corresponding lower back wall extension whereby a base for said display card having a right triangular cross section is formed, e. an upper extension panel hingedly attached to and extending upwardly and outwardly from said upper end of said front wall, f. a glue panel extension hingedly attached to said upper extension panel and extending vertically therefrom, g. said panel extension on said upper end of said back wall comprising:

i. a first extension panel hingedly attached to said upper end of said back wall and folded inwardly towards said glue panel extension, ii. a second extension panel hingedly attached to said first extension panel and folded downwardly in juxtaposed relationship to said glue panel, iii. a third extension panel hingedly attached to said second extension panel and folded outwardly, spaced apart from, of equal length width and parallel to said first extension panel, and iv. a fourth extension panel hingedly attached to said third extension panel and folded downwardly in abutting relationship with said back wall, h. means for attaching said glue panel to said second extension panel and attaching said fourth extension panel to said back wall thereby forming a panel top of right triangular cross section having a buffer of rectangular cross section formed above and with said panel top, and i. an orifice in both the inner wing of said lower V-shaped panel and the upper extension panel in opposing relationship whereby a product may be secured in said orifices for display and protection purposes.

14. A display card as in claim 13 wherein said lower inner wing orifice is larger than said upper extension panel orifice for securing and displaying a product whose base is larger than its top.

15. A display card as in claim 14 wherein said front wall and said back wall are integrally formed with and hingedly connected to each other along at least a portion of one side thereof and superimposed over and attached to each other in overlapping relationship.

16. A display card as in claim 15 wherein said front wall and said back wall are adhesively secured together.

17. A display card blank comprising:

a. a front wall and a back wall hingedly attached to each other along at least a portion of one edge, b. an extension panel hingedly attached to each end of said back wall, c. an extension panel hingedly attached to each end of said front wall, each front wall extension panel comprising inner and outer wings hingedly attached to each other, and d. an orifice in said inner wing of each said front wall extension panel.

18. A display card blank as in claim 17 further comprising:

a. at least one glue strip on each outer wing of each front wall extension for attachment to a corresponding back wall extension, and b. at least one glue strip extending across at least one of said front or back wall for attaching said front and back walls to each other in an overlapping relationship.

19. A display card as in claim 18 wherein said orifice in one of said front wall extensions is larger than the other.

20. A display card blank comprising:

a. a front wall and a back wall hingedly attached to each other along at least a portion of one edge, b. an extension panel hingedly attached to each end of said back wall, c. an extension panel hingedly attached to each end of said front wall, each said front wall extension comprising inner and outer wings hingedly attached to each other, d. a display panel hingedly attached to the outer edge of the upper one of said outer wings, and e. an orifice in said inner wing of each said front wall extension.

21. A display card as in claim 20 further comprising:

a. at least one glue strip on said display panel attached to said one outer wing for attachment to a corresponding back wall extension, b. at least one glue strip on said other outer wing for attachment to the other back wall extension, and c. at least one glue strip extending across at least one of said front or back walls for attaching said front and back walls to each other in an overlapping relationship.

22. A display card as in claim 21 wherein said orifice in one of said inner wings is larger than the other orifice.

23. A display card blank comprising:

a. a front wall and a back wall each having at least a portion of one edge hingedly attached to each other, b. an extension panel hingedly attached to each end of said back wall, one of said back wall extension panels having four sections hingedly attached to each other which, when folded upon consecutive hinge lines, forms an open ended rectangular box of rectangular cross section with the outer section lying against said back wall, c. an extension panel hingedly attached to each end of said front wall, each said front wall extension comprising inner and outer wings hingedly attached to each other, and d. an orifice in said inner wing of each said front wall extension.

24. A display card blank as in claim 23 further comprising:

a. at least one glue strip on each outer wing of said front wall extension whereby said lower extension outer wing may be attached to a corresponding back wall extension to form a card base and the upper wing may be attached to said second section of said back wall extension panel thereby forming the front panel of said rectangular box, b. at least one glue strip extending across at least one of said front or back walls for attaching said front and back walls in an overlapping relationship, and c. at least one glue strip on said fourth section of said one back wall extension for attaching said fourth section to said back wall.

25. A display card blank as in claim 24 wherein said orifice in one of said front wall extensions is larger than the other.

* * * * *